United States Patent [19]

Mrenna et al.

[11] Patent Number: 4,691,182

[45] Date of Patent: Sep. 1, 1987

[54] CIRCUIT BREAKER WITH ADJUSTABLE MAGNETIC TRIP UNIT

[75] Inventors: Stephen A. Mrenna, Brighton Twp., Beaver County; Michael J. Whipple, New Sewickley, both of Pa.

[73] Assignee: Westinghouse Electric Corp., Pittsburgh, Pa.

[21] Appl. No.: 858,137

[22] Filed: Apr. 30, 1986

[51] Int. Cl.[4] ..... H01H 9/00

[52] U.S. Cl. ..... 335/176; 335/42

[58] Field of Search ..... 335/176, 42, 45, 172, 335/174

[56] References Cited

U.S. PATENT DOCUMENTS

| | | | |
|---|---|---|---|
| 3,530,414 | 9/1970 | Wagner | 335/174 |
| 3,593,234 | 7/1971 | Charbonneau | 335/176 |
| 3,797,007 | 3/1974 | Salvati et al. | 335/176 |
| 3,815,064 | 6/1974 | Maier et al. | 335/176 |
| 3,906,414 | 9/1975 | Kidd et al. | 335/42 |
| 3,950,717 | 4/1976 | Cellerini et al. | 335/176 |
| 4,074,218 | 2/1978 | Salvati et al. | 335/42 |
| 4,126,210 | 11/1978 | Martin . | |
| 4,164,001 | 8/1979 | Sherwood . | |
| 4,313,098 | 1/1982 | Salvati | 335/42 |
| 4,425,603 | 1/1984 | Courson . | |

*Primary Examiner*—E. A. Goldberg
*Assistant Examiner*—Lincoln Donovan
*Attorney, Agent, or Firm*—L. P. Johns

[57] ABSTRACT

A circuit breaker structure having an adjustable magnetic trip unit characterized by an insulating housing containing a circuit breaker mechanism having separable contacts and containing a trip unit comprising a magnetic device responsive to overload current conditions for separating the contacts, the magnetic device having an armature and a calibrating screw for calibrating an air gap between the armature and an associated magnet, the trip unit also including a cam for varying the tension of the spring and the cam having spaced indexing indentations and an associated ball in the frame for rolling engagement with the cam surface and for seating in any indentation to provide positive settings of the spring tension.

7 Claims, 6 Drawing Figures

FIG. 4
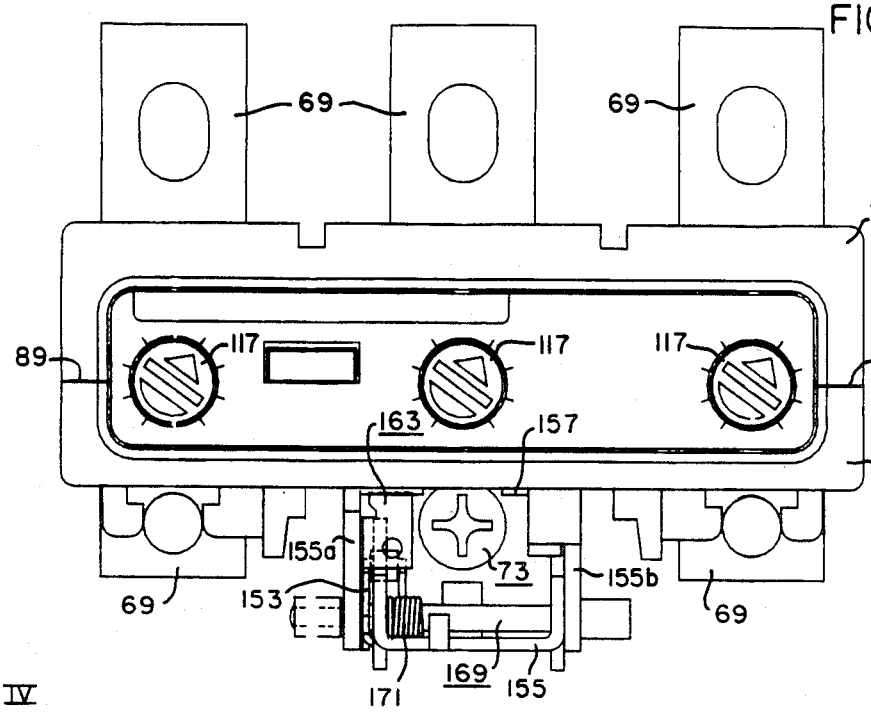
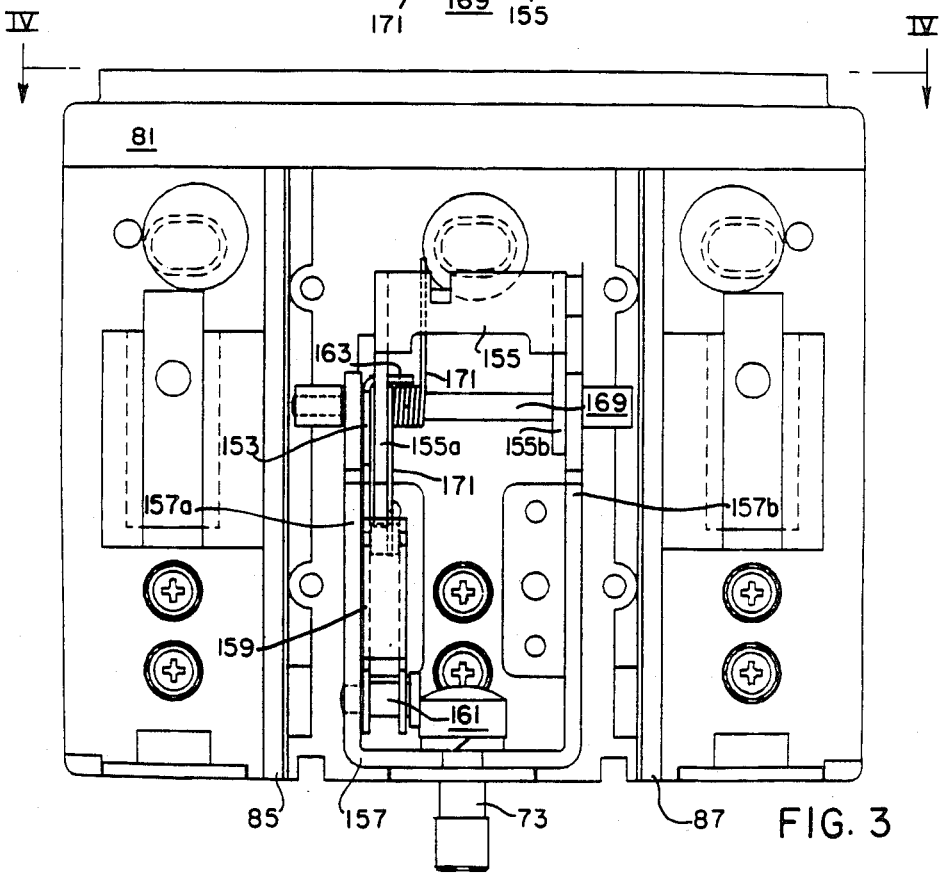
FIG. 3

CIRCUIT BREAKER WITH ADJUSTABLE MAGNETIC TRIP UNIT

BACKGROUND OF THE INVENTION

1. Field of the Invention

This invention relates to a protective device for a circuit interrupter and, more particularly, it pertains to an indexing mechanism for positively indicating the position of an adjustable magnetic trip for changing a trip spring force while maintaining a constant air gap between a magnet and armature of a magnetic sensing device.

2. Description of the Prior Art

In the circuit-interrupting art, compact circuit breakers have evolved that comprise overcurrent protective devices, or trip units, that function in response to such abnormal currents as overcurrents, ground fault currents, and short circuits that occur in an electrical distribution system. Such trip units are disposed in U.S. Pat. Nos. 3,530,414; 3,797,007; 3,808,847; 3,815,064; 3,950,716; 3,950,717; 4,074,218; and 4,313,098. Although these circuit breakers have a greater range for adjusting for specific trip currents between maximum and minimum air gaps between the magnet and the armature of the trip units, there is a need for an adjustable indexing device that provides positive settings at which a predetermined force is established and maintained on the tension spring of an armature.

SUMMARY OF THE INVENTION

In accordance with this invention it has been found that the foregoing need may be satisfied by providing a circuit breaker structure for responding to abnormal current conditions in an electrical distribution system, comprising a first insulating housing, a circuit breaker mechanism having separable contacts and a releasable member movable to an unlatched position from a latched position to effect opening of the contacts; a latch lever movable between latched and unlatched positions of the releasable member and being biased in the latched position; a trip bar movable to unlatch the latch lever and being biased in the latch position; a trip unit comprising a stationary magnetic structure for each conductor of the distribution system and including a coil and a core assembly and an armature; lever means associated with each stationary magnetic structure for moving the trip bar to the unlatched position; the lever means comprising the armature and being movable in response to abnormal currents in at least one of the conductors; a calibrating screw mounted in the first housing for moving the armature with respect to the coil and core assembly for calibrating an air gap therebetween; tension means for varying tension on the lever means and comprising adjustable spring means operatively connected to the lever means so that the force required to attract the armature to the assembly is adjustable without varying the distance between the armature and the coil and core assembly; the tension means also comprising a manually operable cam and cam follower; the cam follower being operatively connected to the spring means for increasing and decreasing tension on the spring means in response to rotation of the cam; indexing means adjacent to and contacting the cam for positively indicating the position of the cam; the trip unit including the tension means being contained within the first housing; the cam including an adjusting knob extending through a hole in the first housing; the cam including a flange; the indexing means including a ball and spaced ball-receiving indentations in the flange and the ball being biased into the indentation; and a second housing containing the circuit breaker mechanism and the first housing being detachably mounted within the second housing.

The advantage of the device of this invention is that it provides an improved means for changing the spring force on the armature by use of a ball bearing that provides positive indexing and an indentation for each indexed position.

BRIEF DESCRIPTION OF THE DRAWINGS

FIG. 3 is a vertical sectional view taken on the line III—III of FIG. 2;

FIG. 4 is a plan view taken on the line IV—IV of FIG. 3;

DESCRIPTION OF THE PEFERRED EMBODIMENTS

Figure 1:
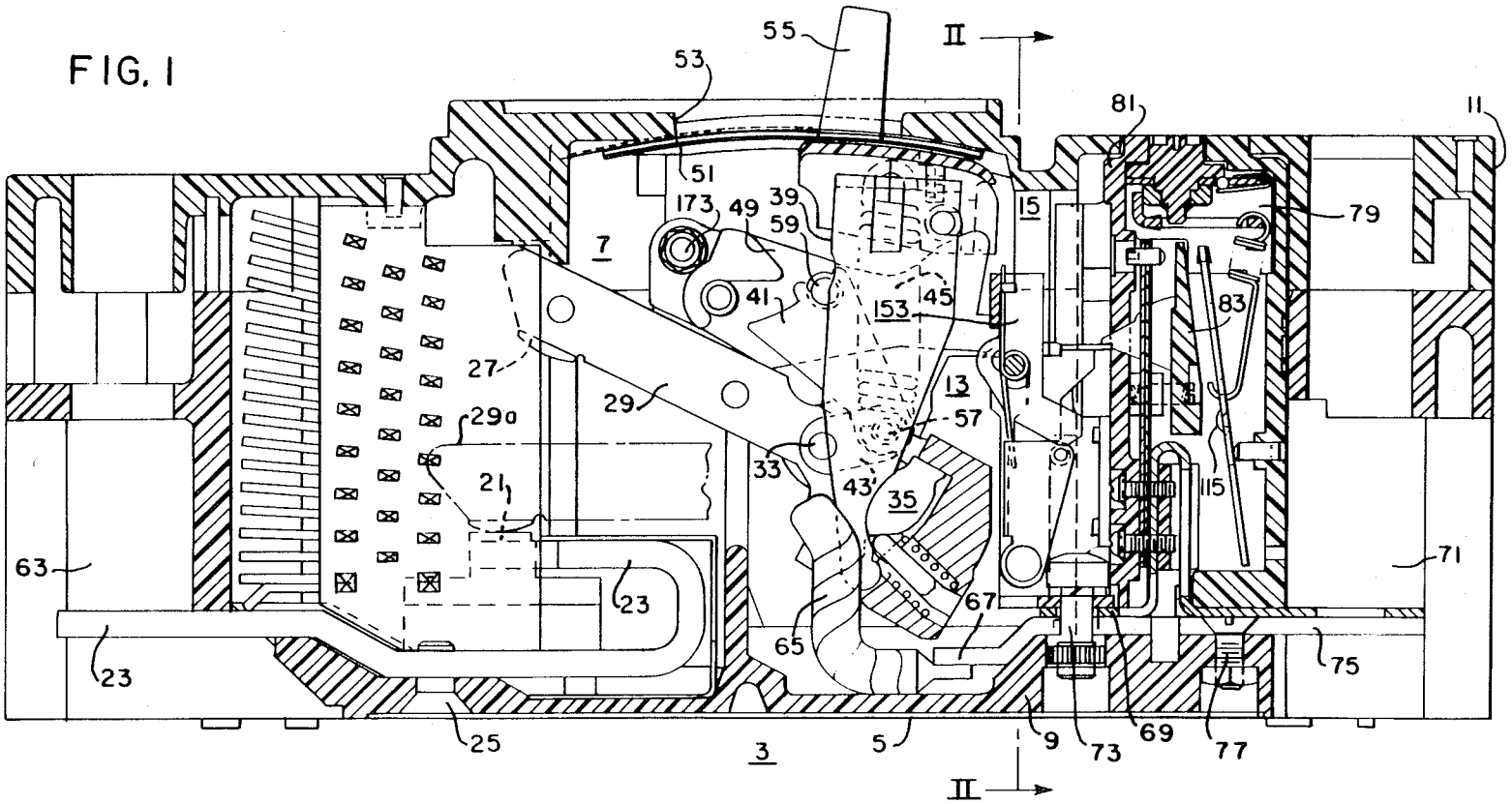
FIG. 1 is a vertical sectional view of a multi-pole circuit breaker.

In FIG. 1, a circuit breaker is generally indicated at 3 and it comprises an insulating housing 5 and a circuit breaker mechanism 7 supported within the housing. The housing 5 comprises an insulating base 9 and an insulating cover 11.

The circuit breaker mechanism 7 comprises an operating mechanism 13, and a latch and trip device 15. Except for the latch and trip device, the circuit breaker 3 is of the type that is generally described in U.S. Pat. No. 3,797,009 and is incorporated by reference herein. The circuit breaker 3 is a three-pole circuit breaker comprising three compartments disposed in side-by-side relationship. The center pole compartment (FIG. 1) is separated from the two outer pole compartments by insulating barrier walls formed with the housing base 9 and cover 11. The operating mechanism 13 is disposed in the center pole compartment and is a single operating mechanism for operating the contacts of all three pole units.

Each pole unit comprises a stationary contact 21 that is fixedly secured to a rigid main conductor 23 that in turn is secured to the base 9 by bolts 25. In each pole unit, a movable contact 27 is secured, such as by welding or brazing, to a contact arm 29 that is mounted on a pivot pin 33. The arm 29 for all three of the pole units is supported at one end thereof and rigidly connected on a common insulating tie bar 35 by which the arms of all three pole units move in unison. Each of the contact arms 29 is biased about the associated pivot pin 33.

The operating mechanism 13 actuates the switch arms 29 between open and closed positions. The mechanism comprises a pivoted formed operating lever 39, a toggle comprising two toggle links 41 and 43, overcenter spring 45 and a pivoted releasable cradle or arm 49 controlled by the trip device 15. An insulating shield 51 for substantially closing an opening 53 in the cover 11, is mounted on the outer end of the operating lever 39 and has an integral handle portion 55 extending out through the opening to enable manual operation of the breaker. The toggle links 41 and 43 are pivotally connected together by a knee pivot pin 57. The toggle link 41 is pivotally connected to the releasable arm 49 by a pin 59, and the toggle link 43 is pivotally connected to the switch arm 31 of the center pole unit by the pin 33.

The overcenter spring 45 is connected under tension between the knee pivot pin 57 and the outer end of the operating lever 39. The circuit breaker is manually operated to the open position by movement of the handle portion 55 in a clockwise direction, which movement actuates the overcenter spring 45 to collapse the toggle links 41 and 43 to the "off" position (FIG. 1), and opening movement of the contact arm 29 for all of the pole units in a manner well known in the art.

The circuit breaker is manually closed by counterclockwise movement of the handle portion 55 from the "off" position to the "on" position, which movement causes the spring 45 to move overcenter and straighten the toggle links 41, 43 thereby moving the contact arm 29 for all of the pole units to the closed position as shown in broken line position 29*a*.

The trip device 15 serves to effect automatic release of the releasable cradle or arm 49 and opening of the breaker contacts for all of the pole units, in response to predetermined overload conditions in the circuit breaker through any or all pole units of the circuit breaker, in a manner described hereinbelow.

The circuit through each pole unit extends from a left-hand terminal 63 through the conductor 23, the contacts 21, 27, the contact arm 29, a flexible conductor 65, a conductor 67, a trip conductor 69, and to a right-hand terminal connector 71. Bolt 73 secures one end of the trip conductor 69 to the conductor 67 and the other end of the trip conductor 69 is disposed between a backup plate 75 and the terminal 71 where it is secured in place by mounting bolt 77 of the terminal 71.

Figure 2:
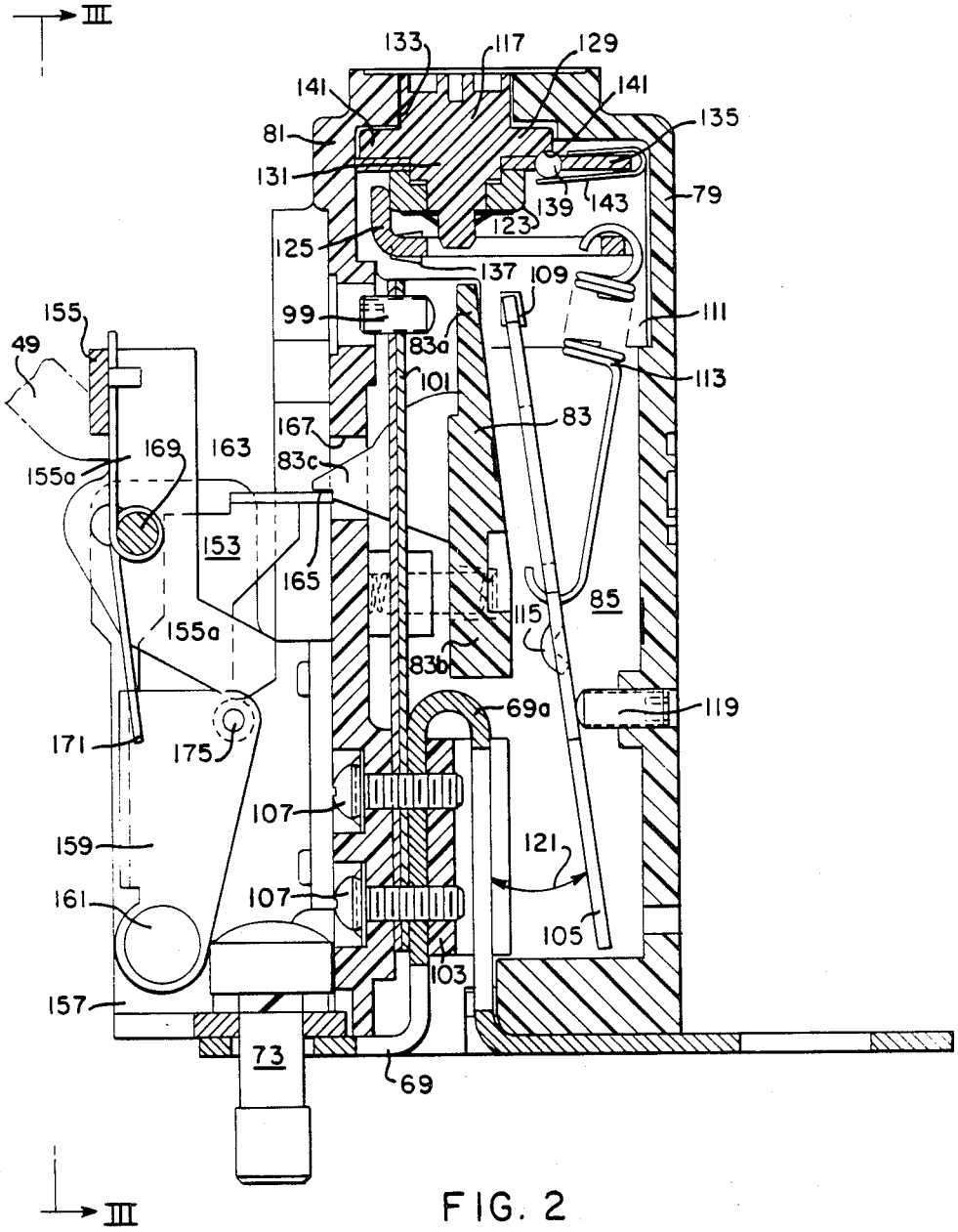
FIG. 2 is an enlarged vertical sectional view of the trip unit.

As shown in FIGS. 2–4 the latch and trip device 15 comprises a molded insulating housing base 81 and a molded insulating housing cover 79 secured to the base to enclose a molded insulating trip bar 83 that is common to all three of the pole units. The base 81 (FIGS. 2 and 4) includes a pair of spaced partitions 85 and 87 which are vertically disposed and integral with the base for separating the interior of the housing into three compartments, each compartment containing one of the three poles. In a similar manner, the cover 79 is provided with partitions corresponding to partitions 85 and 87 and having mating surfaces therewith in a manner similar to the mating surfaces of the peripheral surfaces of the base 81 and cover 79 as indicated by a parting line 89 (FIG. 4).

The partitions 85 and 87 serve as journals for the trip bar 83. Accordingly, when the housing base 81 and cover 79 are assembled, the trip bar 83 is retained in place, whereby the trip bar is free to rotate. Each section of the trip bar 83 located within the space compartments of the housing comprises upper and lower portions 83*a* and 83*b*, which are above and below the axis of rotation of the trip bar. Each upper portion 83*a* cooperates with a screw 99 on a bimetal member 101 (FIG. 2) for adjusting the spacing between the upper ends of the bimetal member and the trip bar portion 83*a* in response to the degree of deflection of the upper end of the member 101 toward the member 83*a*, whereby the trip bar 83 is rotated clockwise by the bimetal member and thereby trips the circuit breaker to the open position. The lower end portion 83*b* of the trip bar 83 is rotated by an armature 105 in the manner to be described hereinbelow.

The trip conductor 69 (FIG. 2) includes an inverted U-shaped intermediate portion 69*a* which constitutes a single loop of a stationary magnetic, which comprises a magnetic core 103 and an armature 105. The assembly of the intermediate U-shaped portion 69*a*, the core 103, and the lower portion of the bimetal member 101 are secured in place by suitable means such as screws 107 on the housing base 81. The lower end portion of the bimetal member 101 is in surface-to-surface contact with the conductor 69, whereby upon the occurrence of a low persistent overload current below a predetermined value of, for example, five times normal rated current, the bimetal member 101 is heated and deflects to the right through an air gap dependent upon the setting of the adjustment screw 99. Thus, the trip bar 83 is actuated to trip the circuit breaker.

The armature 105 is pivotally mounted in an opening 109 on a holding bracket 111 and is biased in the counterclockwise direction by coil springs 113 (FIG. 2). The armature has a projection 115 and is movable clockwise against the spring to rotate the trip bar 83 clockwise. When an overload current above a value such, for example, as five times normal rated current or a short circuit current occurs, the stationary magnetic structure is energized and the armature 105 is attracted toward the core 103, causing release of the arm 49 and opening of the contacts 21 and 27.

A calibration screw 119 is provided in the housing cover 79 for adjusting the spacing between the armature 105 and the core 103, whereby upon maximum spacing of the armature from the core, a greater current overload is required to attract the armature toward the core. Conversely, when the spacing is reduced, a smaller overload current is required to actuate the trip bar 83. However, inasmuch as the trip unit 15 comprises an adjusting knob 117, the calibration screw 119 is preset to a prescribed air gap 121 after final assembly.

In accordance with this invention the adjusting knob 117 is provided for changing the rating of the circuit breaker 15 by varying the force on the spring 113. The adjusting knob 117 is part of a spring tensioning assembly which also includes a cam 123, and a cam follower 125. The adjusting knob 117 includes a circular surface 127, a radial flange 129, and a shaft 131 on which the cam 123 is mounted. The adjusting knob 117 is mounted within a circular opening 133 of the housing. The adjusting knob 117 is retained in place by a retainer 135 which is part of the holding bracket 111.

The cam follower 125 is a lever, such as a bell crank, having one end portion contacting the surface of the cam 123 and the other end portion connected to the upper end of the coil spring 113. The lower end of the spring is connected to the armature 105. The cam follower is pivotally mounted in an opening 137 of the holding bracket 111. In this manner the tension of the spring 113 holds the cam follower 125 against the cam surface 123.

Associated with the adjusting knob 117 is an index means including a ball bearing 139, and spaced indentations 141 around the lower surface of the radial flange 129 for receiving the ball bearing at prescribed positions of rotation of the index knob 117. A leaf spring 143 retains the ball bearing in place within an aperture of the retainer 135. The ball bearing 139 provides positive indexing or indication of the position of the knob as established by the spaced positions of the indentations 141 around the flange 129. An advantage of the ball bearing 139 is that it reduces rotational friction by rolling on the surface of the flange 129, thereby facilitating rotation of the knob. When the ball bearing 139 is seated within an indentation 141, any vibrations occurring within the circuit breaker are less likely to change the setting of the knob and thereby alter the rating established thereby.

Figure 5:
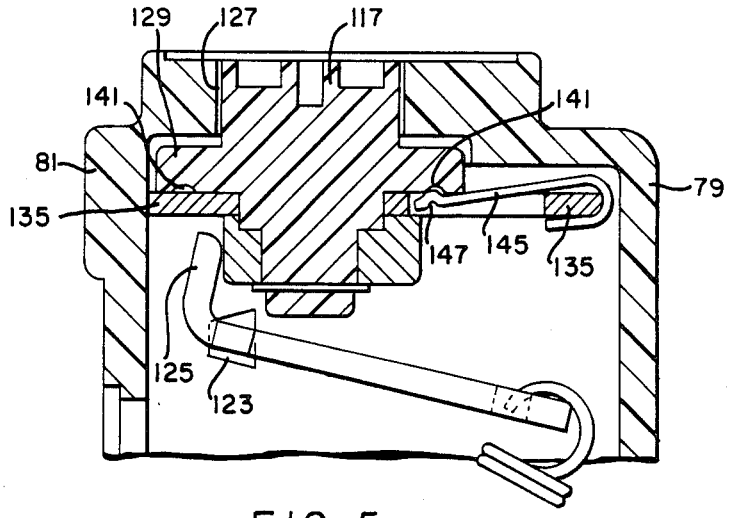
FIGS. 5 and 6 are fragmentary sectional views of other embodiments of the invention.
Figure 6:
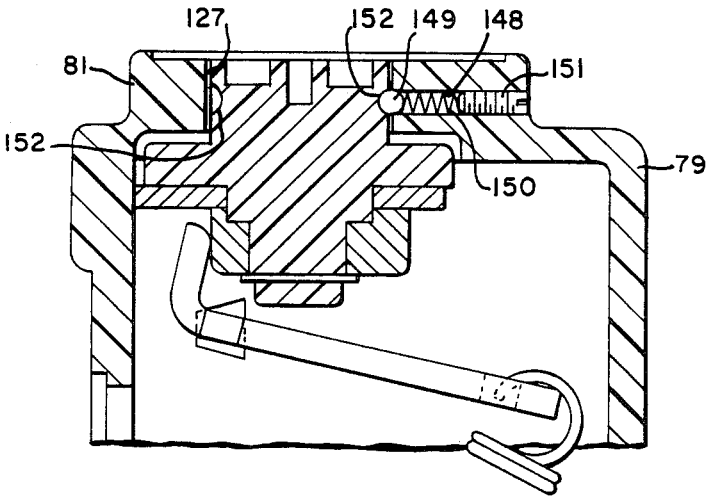

Other embodiments of the invention are shown in FIGS. 5 and 6 in which similar reference numbers refer to similar parts. In FIG. 5 a leaf spring 145 is disposed in conjunction with the retainer 135. The spring 145 comprises a projection 147 having a rounded top surface that is disposed in alignment with the indentations 141 on the flange 129 for providing positive indexing of the adjustment knob 117.

In FIG. 6 the cover 79 includes a bore 148 in the cover 79 contains a ball bearing 149, a coil spring 150, and a retainer screw 151. The ball bearing 149 is in alignment with a plurality of peripherally spaced indentations 152, whereby indexing of the adjustment knob 117 is maintained with a positive indication in a manner similar to those of FIG. 5 and 6.

The mechanism by which the releasable arm 49 is released is shown in FIGS. 1, and 2. The mechanism includes the trip bar 83, a trip lever 153, and a latch lever 155. A U-shaped mounting frame 157 is mounted on the base 81 with spaced upright sides 157*a* and 157*b* (FIGS. 2, 4) providing mounting support for the levers. The trip lever 153 includes a U-shaped lever 159, the lower end of which is mounted on a pivot pin 161 which extends from the side 157*a* of the frame. The U-shaped lower portion of the lever 159 maintains the lever upright adjacent the frame side 157*a*. The upper end of the trip lever 153 includes a flange 163 which engages a notch 165 on the trip bar 83. As shown in FIG. 2 a portion of the trip bar extends through an opening 167 in the insulating base 81.

The latch lever 155 includes down-turned portions 155*a* and 155*b* (FIG. 3) which are mounted on a pivot pin 169 the opposite ends of which are secured in the sides 157*a* and 157*b* of the frame 157. A spring 171 is mounted on the pin 169 and has end portions engaging the levers 153 and 159 for biasing the levers in the latch positions. When the releasable arm 49 is in the latched position (FIG. 1), the arm, which is pivoted on a pivot pin 173, is secured in the latched position below the lever 155 and applies a rotatable force thereon. The latch lever 155 is prevented from turning due to engagement of the lower end of the lever on a pin 175 which is mounted in the U-shaped portion 159 on the trip lever 153. As a result of the rotating force on the latch lever 155, the trip lever 153 is biased clockwise and is prevented from movement by engagement of the flange 163 in the notch 165 of the trip bar 83. When the trip bar is rotated clockwise, the flange 163 is dislodged from the latched position within the notch 165 and the trip lever 153 rotates clockwise to move the pin 175 from engagement with the lower end of the latched lever 155. As a result the latch lever 155 is free to rotate about the pin 169 and thereby unlatch the releasable arm 49 from the latched position.

Accordingly, the device of the present invention provides a new and novel index mechanism for trip structure for a circuit breaker which comprises means for changing the electrical current range of the magnetic circuit.

What is claimed is:

1. A circuit breaker structure for responding to abnormal current conditions in an electrical distribution system, comprising:

a circuit breaker mechamism having separable contacts and having a releasable member movable to an unlatched position from a latched position to effect opening of the contacts;

a latch lever movable between latched and unlatched positions of the releasable member and being biased in the latched position;

a trip bar movable to unlatch the latch lever and being biased in the latched position;

a trip unit comprising a stationary magnetic structure for each conductor of the distribution system and including a coil and core assembly and an armature;

lever means associated with the stationary magnetic structure for moving the trip bar to the unlatched position;

the lever means comprising the armature and movable in response to abnormal currents in at least one of the conductors;

the armature being positioned at a constant distance from said assembly;

tension means for varying tension on the lever means and comprising adjustable spring means operatively connected to the lever means so that the force required to attract the armature to the assembly is adjustable without varying the distance between the armature and the coil and core assembly;

the tension means also comprising a manually operable cam and a cam follower;

the cam follower being operatively connected to the spring means for increasing and decreasing tension on the spring means in response to rotation of the cam; and indexing means adjacent to and contacting the cam for positively indicating the position of the cam and comprising a retractable member and spaced member-receiving indentations, one of which is disposed in the housing and the member being biased into the indentations, whereby an adjustable magnetic trip is effected by changing the spring force on the armature.

2. The circuit breaker structure of claim 1 in which the trip unit including the tension means are contained within a first housing.

3. The circuit breaker structure of claim 2 in which the cam includes an adjusting knob extending through a hole in the first housing.

4. The circuit breaker structure of claim 3 in which the retractable member includes a ball and the member-receiving indentations include spaced ball-receiving indentations.

5. The circuit breaker structures of claim 4 in which the cam includes a flange comprising the indentations.

6. The circuit breaker structure of claim 5 in which a calibrating screw is mounted in the housing for moving the armature with respect to the coil and core assembly.

7. The circuit breaker structure of claim 6 in which a second housing contains the circuit breaker mechanism and the first housing being detachably mounted within the second housing.

* * * * *